US007412187B2

(12) United States Patent
Ahn

(10) Patent No.: US 7,412,187 B2
(45) Date of Patent: Aug. 12, 2008

(54) APPARATUS AND METHOD FOR CLEANING THE TRANSFER ROLLER OF IMAGE FORMING APPARATUS

(75) Inventor: Myung-kook Ahn, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 303 days.

(21) Appl. No.: 11/263,862

(22) Filed: Nov. 2, 2005

(65) Prior Publication Data

US 2006/0120749 A1 Jun. 8, 2006

(30) Foreign Application Priority Data

Dec. 3, 2004 (KR) ..... 10-2004-0100854

(51) Int. Cl.
*G03G 15/16* (2006.01)

(52) U.S. Cl. ..... 399/101; 399/297; 399/313

(58) Field of Classification Search ..... 399/66, 399/101, 297, 313
See application file for complete search history.

(56) References Cited

U.S. PATENT DOCUMENTS 6,035,157 A * 3/2000 Takahashi et al. ..... 399/101
6,341,205 B1 * 1/2002 Yoshino et al. ..... 399/101
6,490,424 B2 * 12/2002 Okamoto ..... 399/101
7,035,563 B2 * 4/2006 Sawada ..... 399/66
7,110,685 B2 * 9/2006 Shin ..... 399/66

FOREIGN PATENT DOCUMENTS

| | | |
|---|---|---|
| JP | 05-053401 | 3/1993 |
| JP | 2004-004994 | 1/2004 |
| KR | 10-2000-0035645 | 6/2000 |
| KR | 10-2003-0027621 | 4/2003 |
| KR | 10-2004-0054034 | 6/2004 |
| KR | 20-0354765 | 6/2004 |

* cited by examiner

*Primary Examiner*—William J Royer
(74) *Attorney, Agent, or Firm*—Roylance, Abrams, Berdo & Goodman, L.L.P.

(57) ABSTRACT

An apparatus and method for cleaning a transfer roller of a wet-type image forming apparatus are provided. The method includes applying a measured voltage to the transfer roller; measuring a resistance among a transfer backup roller, an intermediate transfer medium, and the transfer roller based on the applied measured voltage; calculating a density of a toner of a developer on the transfer roller based on the measured resistance; and if the density of the toner is more than or equal to a predetermined reference value, supplying a carrier or applying the cleaning voltage. Thus, the cleaning voltage can be adjusted depending on the density of the toner of the developer on the transfer roller so as to maintain appropriate cleaning efficiency. If the density of the toner is greater than or equal to the predetermined reference value, the carrier can be supplied so as to improve the cleaning efficiency.

13 Claims, 7 Drawing Sheets

APPARATUS AND METHOD FOR CLEANING THE TRANSFER ROLLER OF IMAGE FORMING APPARATUS

CROSS-REFERENCE TO RELATED APPLICATIONS

This application claims the benefit under 35 U.S.C. §119 (a) of Korean Patent Application No. 2004-100854, filed on Dec. 3, 2004, in the Korean Intellectual Property Office, the entire disclosure of which is hereby incorporated by reference.

BACKGROUND OF THE INVENTION

1. Field of the Invention

The present invention relates to an apparatus for cleaning a transfer roller. More particularly, the present invention relates to an apparatus and a method for cleaning a transfer roller of a wet-type image forming apparatus so as to remove a contamination of the transfer roller by transferring an image formed on an intermediate transfer medium to a printing paper in the wet-type image forming apparatus using a liquid developer.

2. Description of the Related Art

In general, image forming apparatuses may be classified into dry-type image forming apparatuses that use a powdered dry-type developer and wet-type image forming apparatuses that use a liquid developer. The dry-type and wet-type image forming apparatuses each have their own advantages and disadvantages. However, the wet-type image forming apparatus can obtain a clearer, higher resolution printed document than the dry-type image forming apparatus and thus is particularly suitable for color printing. In the case of the wet-type image forming apparatus, a developer including a mixture of powdered toner with a predetermined color and a liquid carrier for assisting movement of the toner is used during developing and transferring processes.

FIG. 1 is a schematic view of a general electrophotographic wet-type image forming apparatus.

In the general electrophotographic wet-type image forming apparatus, electrostatic latent images are formed on four photosensitive bodies 11, 12, 13, and 14, which are charged with predetermined potentials via charging units (not shown), by laser beams emitted from exposing units (not shown). The four colors are typically cyan (C), magenta (M), yellow (Y), and black (K). Developers with predetermined colors are respectively supplied to the photosensitive bodies 11, 12, 13, and 14 so as to develop the electrostatic latent images as visible images. First transfer rollers 21, 22, 23, and 24 transfer the visible images to an intermediate transfer belt (ITB) 30 50 that the visible images are overlapped on the ITB 30. A second transfer roller 36 transfers the overlapped image to a printing paper P. ITB 30 is supported by and revolves around support rollers 32, 33, first transfer rollers 21, 22. 23, and 24, and transfer backup roller 34. The printing paper P to which a color image is transferred undergoes a series of fixing processes and then is discharged outside the electrophotographic wet-type image forming apparatus.

When a final image formed on the ITB 30 is transferred to the printing paper P, the second transfer roller 36 contacts the ITB 30 and is supplied with a high voltage so as to transfer the final image to the printing paper P due to an electrostatic attraction.

A transfer characteristic of a transfer system of the electrophotographic wet-type image forming apparatus varies depending on a transfer voltage applied between the second transfer roller 36 and a transfer backup roller 34 for a transfer. When the transfer voltage is low, the electrostatic attraction generated from the second transfer roller 36 is weak. Thus, an image of a developer does not efficiently stick to the printing paper P. As a result, transfer quiver occurs. When the transfer voltage is high, the developer is inversely charged. Thus, the image of the developer does not stick to the printing paper P or the electrostatic attraction generated from the second transfer roller 36 is strong. As a result, the image is transferred before the printing paper P approaches the second transfer roller 36. Also, when the transfer voltage is very high, electric discharge may occur. Thus, an appropriate transfer voltage must be applied during a transfer to avoid a poor transfer.

The appropriate transfer voltage varies depending on a resistance (hereinafter referred to as a transfer part resistance) among the transfer backup roller 34, the ITB 30, and the second transfer roller 36. Thus, a method has recently been adopted of measuring a transfer part resistance prior to a transfer, determining a transfer voltage appropriate for the transfer part resistance, and applying the transfer voltage during the transfer.

In a case where a printing paper P does not pass through the second transfer roller 36 at a transfer timing due to a difference between a size of an image and a size of the printing paper P or a jam of the printing paper caused by bad feeding of the printing paper P the image formed on the ITB 30 is transferred to the second transfer roller 36. Thus, the second transfer roller 36 is contaminated by the developer. The resistance of the second transfer roller 36 is increased by the contaminated developer. As a result, a bad transfer occurs during a transfer operation, and a contaminated image stains a rear side of the printing paper P. Therefore, the contaminated developer must be removed from the second transfer roller 36 so as to obtain a uniform, high-quality image.

In a known method of removing the contaminated developer from the second transfer roller 36, an inverse transfer bias, that is, a cleaning voltage, is applied to the second transfer roller 36 in a transfer section so as to transfer the contaminated developer to the ITB 30. The developer inversely transferred to the ITB 30 is cleaned by a cleaning blade 40. However, according to this method, a constant cleaning voltage is used during the inverse transfer regardless of a contamination degree of the second transfer roller 36. Thus, the second transfer roller 36 is not efficiently cleaned.

Also, the contaminated developer sticking on the second transfer roller 36 is squeezed by a pressure applied to the second transfer roller 36 during the rotation of the second transfer roller 36. Thus, the amount of carrier of the developer is reduced, and a density of the toner is increased. However, in a current transfer method, if a density of toner of a developer exceeds 35%, transfer efficiency is sharply reduced. Thus, a transfer and an inverse transfer are not properly achieved. As shown in FIG. 2, if the second transfer roller 36 rotates once or more while contaminated with developer, the density of the toner increases above 35%. Thus, it is very difficult to inversely transfer the contaminated developer on the second transfer roller 36 to the ITB 30 by applying an inverse transfer bias.

Accordingly, there is a need for an improved apparatus and method for cleaning developer from a contaminated transfer roller.

SUMMARY OF THE INVENTION

Accordingly, the present general inventive concept has been made to solve the above-mentioned and other problems, and provide other advantages that will become apparent from the following description. An aspect of the present general inventive concept is to provide an apparatus and a method for cleaning a transfer roller by sensing a contamination state of a developer sticking to the transfer roller and adjusting and applying a cleaning voltage according to the sensing result.

Another aspect of the present general inventive concept is to provide an apparatus and a method for smoothly cleaning a transfer roller of a wet-type image forming apparatus by supplying a carrier to a developer that has contaminated the transfer roller and a method of cleaning the transfer roller.

According to an aspect of the present invention, there is provided an apparatus for applying a cleaning voltage to a transfer roller of a wet-type image forming apparatus so as to clean the transfer roller. The transfer roller faces a transfer backup roller to transfer an image formed on an intermediate transfer medium to a printing paper. The intermediate transfer medium is installed between the transfer roller and the transfer backup roller. The apparatus includes a voltage source for applying the cleaning voltage among the transfer backup roller, the intermediate transfer medium, and the transfer roller. A controller controls the voltage source to measure a resistance among the transfer backup roller, the intermediate transfer medium, and the transfer roller, determines the cleaning voltage depending on the resistance, and applies the cleaning voltage.

According to another aspect of the present invention, there is provided an apparatus for applying a cleaning voltage to a transfer roller of a wet-type image forming apparatus so as to clean the transfer roller. The transfer roller faces a transfer backup roller to transfer an image formed on an intermediate transfer medium to a printing paper. The intermediate transfer medium is installed between the transfer roller and the transfer backup roller, the apparatus includes a voltage source for applying a cleaning voltage among the transfer backup roller, the intermediate transfer medium, and the transfer roller. A carrier supplying unit is installed around the transfer roller so as to supply a carrier to a developer on the transfer roller. A controller measures a resistance among the transfer backup roller, the intermediate transfer medium, and the transfer roller, and calculates a density of a toner of the developer on the transfer roller depending on the resistance. If the density of the toner is more than or equal to a predetermined reference value, the controller controls the carrier supplying to supply carrier to the developer on the transfer roller.

The controller preferably includes a lookup table storage for storing the densities of the toner of the developer corresponding to values of the resistance.

If the density of the toner is less than the predetermined reference value, the controller preferably controls the voltage source to determine the cleaning voltage depending on the resistance and apply the cleaning voltage.

According to still another aspect of the present invention, there is provided an apparatus for applying a cleaning voltage to a transfer a roller of a wet-type image forming apparatus to clean the transfer roller. The transfer roller faces a transfer backup roller to transfer an image formed on an intermediate transfer medium to a printing paper. The intermediate transfer medium is installed between the transfer roller and the transfer backup roller. The apparatus includes a voltage source for applying a cleaning voltage among the transfer backup roller, the intermediate transfer medium, and the transfer roller. A carrier supplying unit is installed around the transfer roller to supply carrier to a developer on the transfer roller. A density sensor is installed around the transfer roller to measure a density of toner of the developer on the transfer roller. A controller exchanges a signal with the density sensor and if the density of the toner is more than or equal to a predetermined reference value, the controller controls the carrier supplying unit to supply carrier to the transfer roller.

If the density of the toner is less than the predetermined reference value, the controller preferably controls the voltage source to determine the cleaning voltage based on the resistance and applies the cleaning voltage.

According to yet another aspect of the present invention, there is provided a method of applying a cleaning voltage to a transfer roller of a wet-type image forming apparatus to clean the transfer roller. The transfer roller faces a transfer backup roller to transfer an image formed on an intermediate transfer medium to a printing paper. The intermediate transfer medium is installed between the transfer roller and the transfer backup roller. The method includes applying a measured voltage among the transfer backup roller, the intermediate transfer medium, and the transfer roller. A resistance is measured among the transfer backup roller, the intermediate transfer medium, and the transfer roller based on the applied measured voltage. A cleaning voltage is determined and applied based on the measured resistance.

According to yet another aspect of the present invention; there is provided a method of applying a cleaning voltage to a transfer roller of a wet-type image forming apparatus to clean the transfer roller. The transfer roller faces a transfer backup roller to transfer an image formed on an intermediate transfer medium to a printing paper The intermediate transfer medium is installed between the transfer roller and the transfer backup roller. The method includes applying a measured voltage among the transfer backup roller, the intermediate transfer medium, and the transfer roller. A resistance is measured among the transfer backup roller, the intermediate transfer medium, and the transfer roller based on the applied measured voltage. A density of a toner of a developer on the transfer roller is calculated based on the measured resistance. If the density of the toner is more than or equal to a predetermined reference value, a carrier is supplied, and a cleaning voltage is applied.

The method may further include determining and applying the cleaning voltage based on the measured resistance if the density of the toner is less than the predetermined reference value.

The method preferably further includes storing a lookup table comprising density values of the toner of the developer on the transfer roller based on the resistance value among the transfer backup roller, the intermediate transfer medium, and the transfer roller.

The density of the toner of the developer on the transfer roller corresponding to the measured resistance is preferably calculated with reference to the lookup table.

The method preferably further includes standing by for a predetermined time after supplying the carrier.

According to yet another aspect of the present invention, there is provided a method of applying a cleaning voltage to a transfer roller of a wet-type image forming to clean the transfer roller. The method includes calculating a density of a toner of a developer sticking on the transfer roller. A carrier is supplied if the density of the toner is more than or equal to a predetermined reference value, and the cleaning voltage is applied.

The method preferably further includes standing by for a predetermined time after supplying the carrier.

The method preferably further includes determining and applying the cleaning voltage depending on the density of the toner if the density of the toner is less than the predetermined reference value.

BRIEF DESCRIPTION OF THE DRAWINGS

The above aspects and features of embodiments of the present invention will be more apparent with reference to the following description and the accompanying drawings, in which.

Throughout the drawings, like reference numbers should be understood to refer to like elements, features and structures.

DETAILED DESCRIPTION OF EXEMPLARY EMBODIMENTS

Exemplary embodiments of the present invention will be described in greater detail with reference to the accompanying drawings.

The matters defined in the description such as detailed constructions and exemplary embodiments are provided to assist in a comprehensive understanding of the invention. Thus, it should be understood that various changes and modifications to the embodiments described herein can be made without departing from the scope and spirit of the invention. Also, descriptions of well-known functions or constructions are omitted for clarity and conciseness.

Hereinafter, a method of cleaning a transfer roller of a wet-type image forming apparatus according to an embodiment of the present invention will be described with reference to the attached drawings. A method of cleaning a transfer roller according to an embodiment of the present invention is preferably performed when a transferring operation is not performed.

Figure 3:
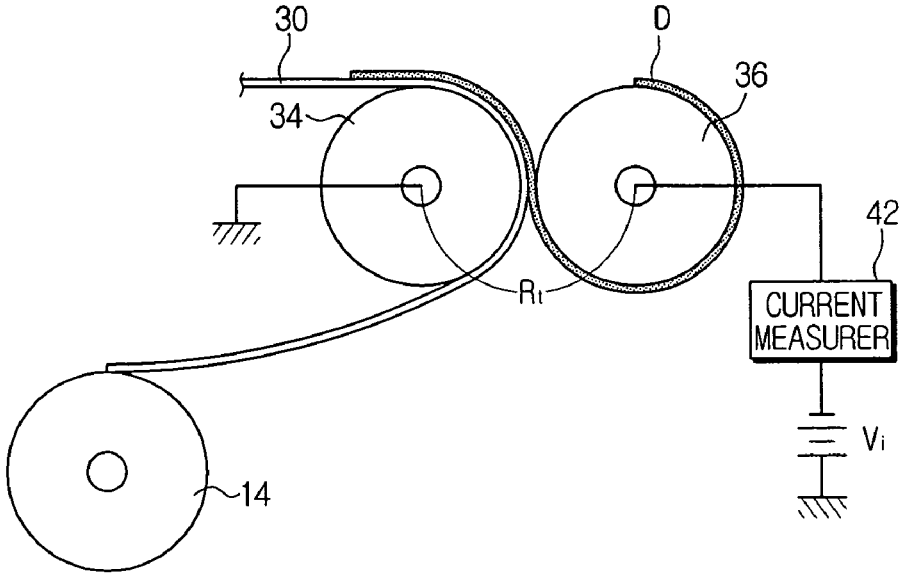
FIG. 3 is a view illustrating the configurations of parts of a wet-type image forming apparatus according to an embodiment of the present invention.
Figure 4:
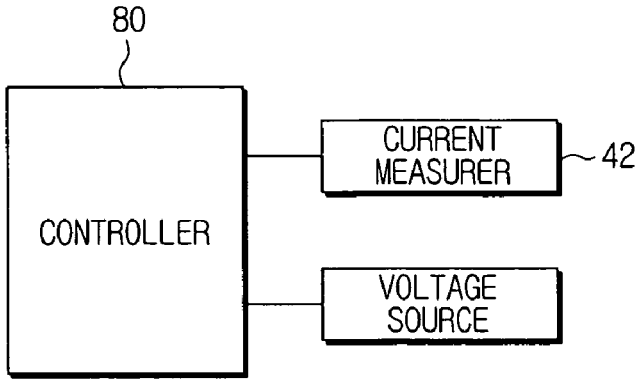
FIG. 4 is a block diagram of an apparatus for cleaning a transfer roller according to an embodiment of the present invention.

Referring to FIGS. 3 and 4, in an embodiment of the present embodiment, a transfer part resistance is measured among a transfer backup roller 34, an ITB 30, and a transfer roller 36 and a cleaning voltage value based on the transfer part resistance is determined and that voltage is applied to clean the transfer roller 36.

A transfer roller cleaning apparatus according to an embodiment of the present embodiment includes a voltage source Vi for applying a voltage to a transfer part, a current measurer 42 for measuring a current flowing in the transfer part, and a controller 80. The current measurer 42 applies a detection resistance and a detection voltage inside to measure a current flowing between the detection resistance and the detection voltage.

The controller 80 measures a transfer part resistance Rt using the current measured by the current measurer 42, determines a cleaning voltage depending on the transfer part resistance Rt, and controls the voltage source Vito apply the cleaning voltage.

Figure 5:
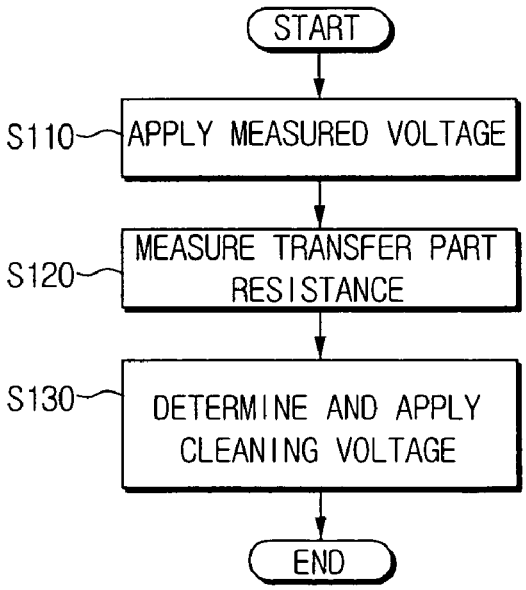
FIG. 5 is a flowchart of a method of cleaning a transfer roller according to an embodiment of the present invention.

A method of cleaning a transfer roller will now be described with reference to FIG. 5.

In operation S110, the controller 80 applies a predetermined measured voltage to the transfer part via the voltage source Vi. The current measurer 42 measures a current using the applied measured voltage.

In operation S120, the controller 80 measures the transfer part resistance Rt using the measured current and the measured voltage.

Figure 1:
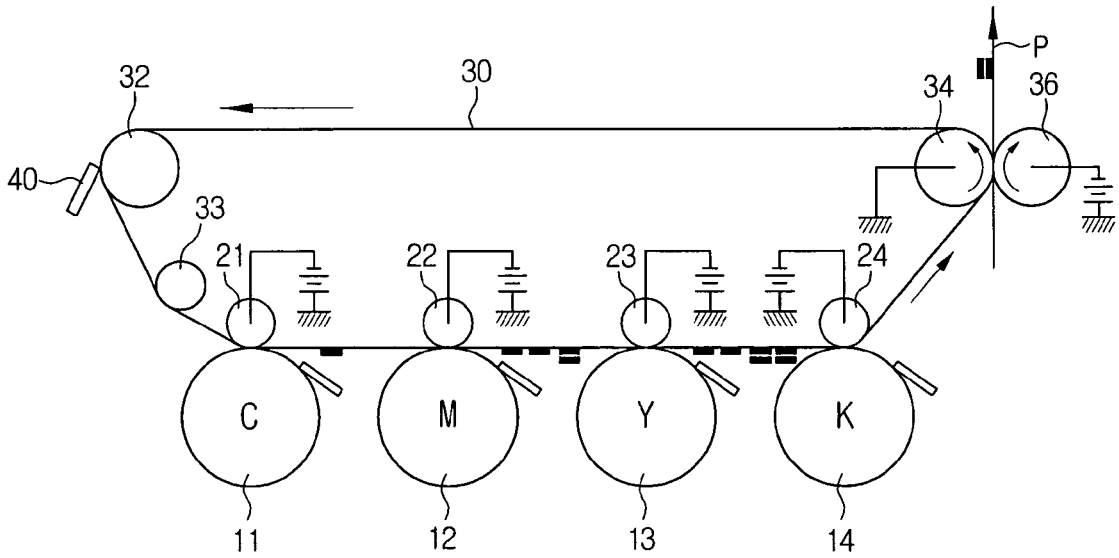
FIG. 1 (PRIOR ART)
FIG. 1 is a schematic view of the configuration of a conventional wet-type image forming apparatus.
Figure 2:
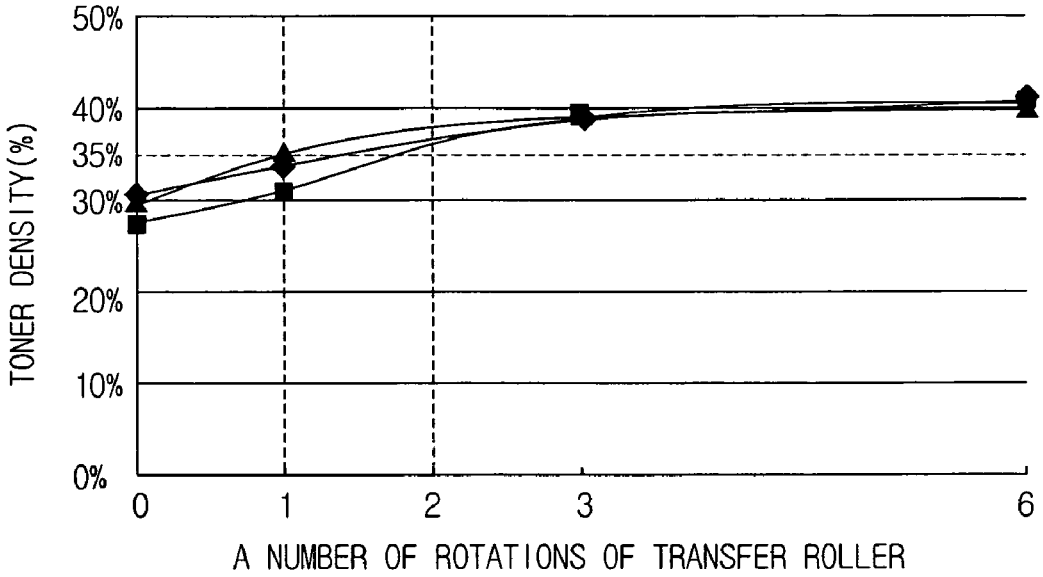
FIG. 2 (PRIOR ART)
FIG. 2 is a graph illustrating a density of a toner of a developer on a transfer roller depending on a number of rotations of the transfer roller shown in FIG. 1.

In operation S130, the controller 80 determines an appropriate cleaning voltage depending on the transfer part resistance Rt and applies the cleaning voltage via the voltage source Vi. The application of the cleaning voltage allows a developer D on the transfer roller 36 to be reverse transferred to the ITB 30 which is then cleaned by a cleaning blade 40 as shown in FIG. 1.

Thus, according to an embodiment of the present embodiment, the cleaning voltage is determined depending on the transfer part resistance Rt, and thus appropriate cleaning can be performed depending on a contamination degree of the developer sticking on the transfer roller 36. The transfer part resistance Rt is preferably a value measured while determining a transfer voltage. Thus, the cleaning voltage as well as the transfer voltage can be determined depending on the transfer part resistance Rt. As a result, cleaning efficiency of the transfer roller 36 can be improved without an additional device.

However, if a density of a toner of the developer D sticking on the transfer roller 36 exceeds 35% as described above, transfer efficiency may be deteriorated. Thus, it is quite difficult to clean the developer D on the transfer roller 36 by only applying the cleaning voltage. In another embodiment the present invention, if the density of the toner of the developer D on the transfer roller 36 is more than or equal to a predetermined reference value, such as 35% for example, a carrier is preferably supplied to lower the density of the toner so as to more easily perform the reverse transfer.

Figure 6:
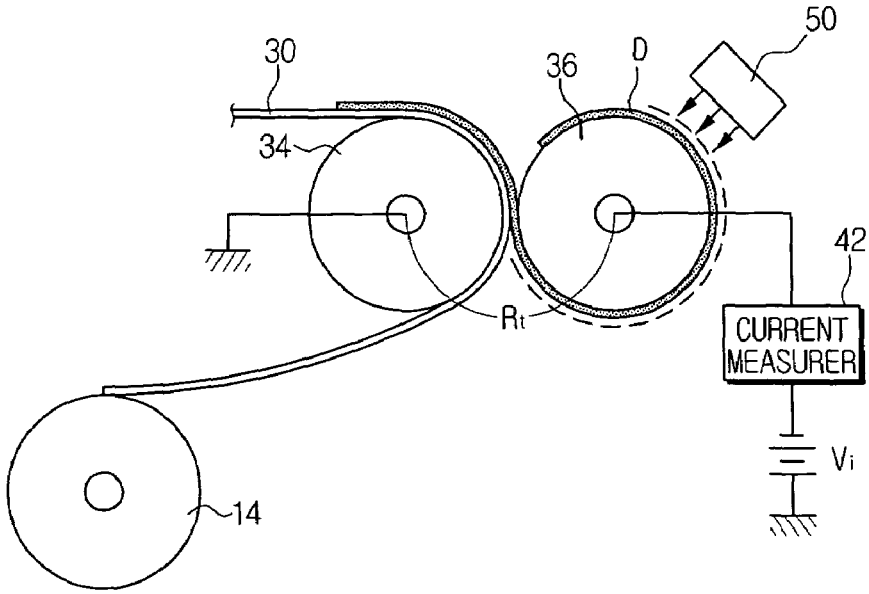
FIGS. 6 and 7 are views illustrating the configurations of parts of a wet-type image forming apparatus according to an embodiment of the present invention.
Figure 7:
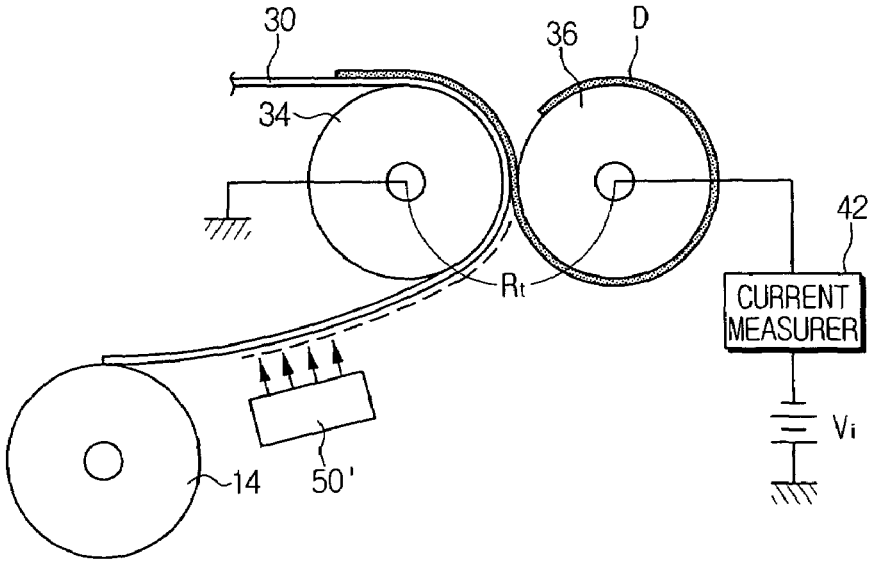
Figure 8:
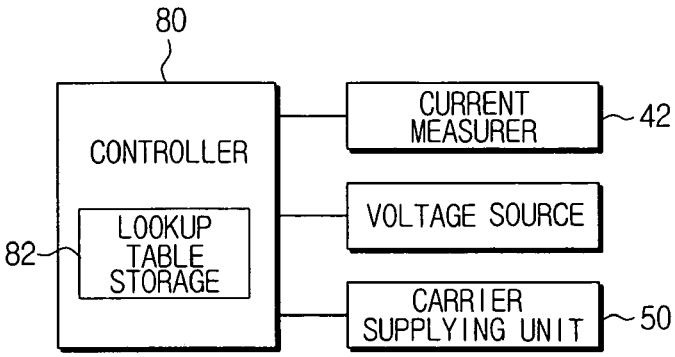
FIG. 8 is a block diagram of an apparatus for cleaning a transfer roller according to an embodiment of the present invention.

Referring to FIGS. 6 through 8, a transfer roller cleaning apparatus according to an embodiment of the invention includes a voltage source Vi for applying a voltage to a transfer part, a current measurer 42 for measuring a current flowing in the transfer part, a carrier supplying unit 50, and a controller 80.

The carrier supplying unit 50 is installed around the transfer roller 36 to supply the carrier to the developer D on the transfer roller 36. The developer D includes powdered toner forming an image and liquid carrier for assisting movement of the toner during the developing and transferring processes. The carrier may be a hydrocarbon-family solvent such as Norpar and Isopar. If a density of the toner of the developer D on the transfer roller 36 is equal to or greater than a predetermined reference value, the carrier supplying unit 50 supplies the carrier to the developer D on the transfer roller 36. The developer D including the supplied carrier can more easily be reverse transferred to the ITB 30 while applying a cleaning voltage due to a decrease in the density of the toner.

The carrier supplying unit 50 is not limited to being installed around the transfer roller 36. As shown in FIG. 7, a carrier supplying unit 50' is installed near the ITB 30 prior to passing through the transfer roller 36 and the transfer backup roller 34 in a traveling path of the ITB 30 to supply carrier to the ITB 30. The carrier supplied to the ITB 30 is mixed with the developer D on the transfer roller 36 while the ITB 30 passes by the transfer roller 36. Thus, the density of the toner of the developer D is reduced.

The controller 80 measures a transfer part resistance Rt using a current measured by the current measurer 42, and calculates the density of the toner of the developer D on the transfer roller 36 based on the transfer part resistance Rt. If the calculated density of the toner is equal to or greater than the predetermined reference value, the controller 80 controls the carrier supplying unit 50' to supply carrier to the transfer roller 36 or the ITB 30. If the calculated density of the toner is less than the predetermined reference value, the controller 80 measures an appropriate cleaning voltage and controls the voltage source Vito apply the appropriate cleaning voltage. The controller 80 preferably includes a lookup table storage 82 for storing densities of the toner of the developer D on the transfer roller 36 which correspond to the measured values of the transfer part resistance Rt. The lookup table storage 82 will be described in greater detail below.

Figure 9:
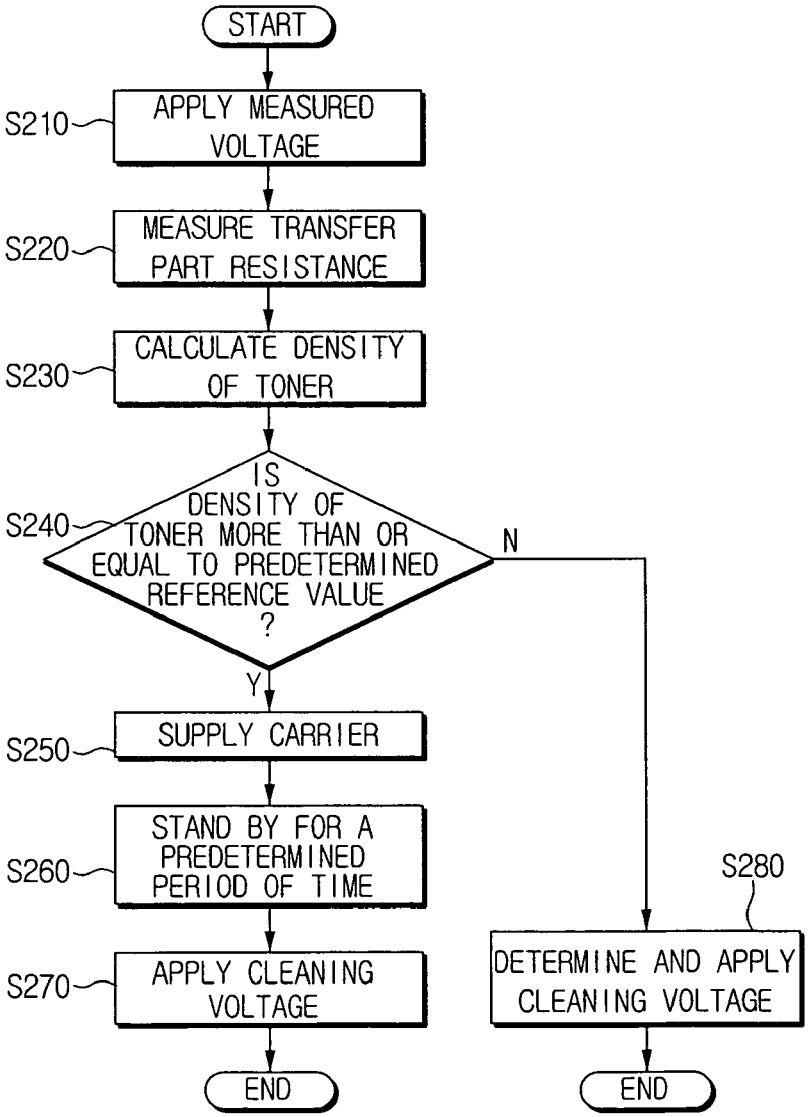
FIG. 9 is a flowchart of a method of cleaning a transfer roller according to an embodiment of the present invention.

A method of cleaning a transfer roller according to another embodiment of the present invention will now be described with reference to FIG. 9.

In operation S210, a measured voltage is applied to a transfer part as in the previous embodiment. In operation S220, a transfer part resistance Rt is measured.

In operation S230, the controller 80 calculates a density of a toner of a developer D on the transfer roller 36 using the transfer part resistance Rt. To calculate the density of the toner, a density value of the toner on the transfer roller 36 based on a resistance value among the transfer backup roller 34, the ITB 30, and the transfer roller 36 is preferably stored in the lookup table storage 82 in advance. To calculate the density value of the toner, an initial transfer part resistance Rt1 is obtained, and then the density of the toner of the developer D is obtained according to an increase ΔR of the initial transfer part resistance Rt1 through an experiment. Here, the initial transfer part resistance Rt1 denotes a case where there is no developer D on the transfer roller 36, that is, a resistance value among the transfer backup roller 34, the ITB 30, and the transfer roller 36, in a clean state. Table 1 below shows densities of the toner of the developer D stored in the lookup table storage 82 based on a transfer part resistance value, the densities being obtained through an experiment.

TABLE 1

| | Transfer part resistance | | |
|---|---|---|---|
| (MΩ) | High Temperature/ High Humidity Toner Density (%) | Normal Temperature/Normal Humidity Toner Density (%) | Low Temperature/ Low Humidity Toner Density (%) |
| 12.50 | 50 | 50 | 39 |
| 11.11 | 50 | 50 | 37 |
| 10.00 | 50 | 50 | 35 |
| 9.09 | 50 | 50 | 33 |
| 8.33 | 50 | 50 | 31 |
| 7.69 | 50 | 50 | 29 |
| 7.14 | 50 | 50 | 27 |

TABLE 1-continued

| | Transfer part resistance | | |
|---|---|---|---|
| (MΩ) | High Temperature/ High Humidity Toner Density (%) | Normal Temperature/Normal Humidity Toner Density (%) | Low Temperature/ Low Humidity Toner Density (%) |
| 6.67 | 50 | 50 | 25 |
| 6.25 | 50 | 50 | 23 |
| 5.88 | 50 | 50 | 21 |
| 5.56 | 50 | 50 | 19 |
| 5.26 | 50 | 49 | 17 |
| 5.00 | 50 | 48 | 15 |
| 4.76 | 50 | 47 | 13 |
| 4.56 | 50 | 46 | 11 |
| 4.35 | 50 | 45 | 9 |
| 4.17 | 50 | 44 | 7 |
| 4.00 | 50 | 43 | 5 |
| 3.85 | 50 | 42 | 3 |
| 3.70 | 50 | 41 | 1 |
| 3.57 | 50 | 40 | 0 |
| 3.45 | 50 | 39 | 0 |
| 3.33 | 50 | 38 | 0 |
| 3.23 | 50 | 37 | 0 |
| 3.13 | 50 | 36 | 0 |
| 3.03 | 50 | 35 | 0 |
| 2.94 | 50 | 34 | 0 |
| 2.86 | 50 | 33 | 0 |
| 2.78 | 50 | 32 | 0 |
| 2.70 | 50 | 31 | 0 |
| 2.63 | 50 | 30 | 0 |
| 2.56 | 50 | 29 | 0 |
| 2.50 | 50 | 28 | 0 |
| 2.44 | 49 | 27 | 0 |
| 2.38 | 48 | 26 | 0 |
| 2.33 | 47 | 25 | 0 |
| 2.27 | 46 | 24 | 0 |
| 2.22 | 45 | 23 | 0 |
| 2.17 | 44 | 22 | 0 |
| 2.13 | 43 | 21 | 0 |
| 2.08 | 42 | 20 | 0 |
| 2.04 | 41 | 19 | 0 |
| 2.00 | 40 | 18 | 0 |
| 1.96 | 39 | 17 | 0 |
| 1.92 | 38 | 16 | 0 |
| 1.89 | 37 | 15 | 0 |
| 1.85 | 36 | 14 | 0 |
| 1.82 | 35 | 13 | 0 |

As shown in Table 1, resistance values on the left side denote transfer part resistances Rt obtained by summing the initial resistance value Rt1 and resistance increases ΔR. The toner density on the right side denotes the density of the toner of the developer D on the transfer roller 36 depending on the transfer part resistances Rt. The toner density varies based on the surroundings of the transfer roller 36 such as high temperature (H)/high humidity (H), normal temperature (N)/normal humidity (N), low temperature (L)/low humidity (L), and the like. Values shown in Table 1 may vary depending on types of toner, and materials and types of the ITB 30 and the transfer roller 36.

Thus, when the transfer part resistance Rt is measured, the density of the toner of the developer D on the transfer roller 36 is calculated to correspond to the measured transfer part resistance Rt as shown in Table 1. In operation S240, the controller 80 determines whether the density of the toner is more than or equal to a predetermined reference value. If the controller 80 in operation S240 determines that the density of the toner is more than or equal to the predetermined reference value, such as 35% for example, then in operation S250 the controller 80 drives the carrier supplying unit 50' to supply carrier to the transfer roller 36 or the ITB 30. Referring to Table 1, in a case where the transfer part resistance Rt is 1.82MΩ under the surrounding condition of the transfer part of H/H, 3.03MΩ under the surrounding condition of the transfer part of N/N, and 10.00MΩ under the surrounding condition of the transfer part of L/L, the density of the toner of the developer D on the transfer roller 36 exceeds 35%. Thus, if the transfer part resistance Rt is 1.82MΩ (H/H), 3.03MΩ (N/N), and 10.00MΩ (L/L) according to the respective surrounding conditions, the carrier is supplied to the transfer roller 36 or the ITB 30. The controller 80 appropriately adjusts an amount of supplied carrier so that the density of the toner of the developer D is within in a range between about 20% and 30% enough to easily perform a transfer. When the density of the toner of the developer D is within the range between about 20% and 30%, the transfer is performed smoothly.

In operation S260, the controller 80 stops driving the transfer roller 36 for a predetermined time so that the carrier is well mixed with the developer D.

In operation S270, the controller 80 applies a cleaning voltage to the transfer roller 36 so as to reverse transfer the developer D on the transfer roller 36 to the ITB 30. Because the density of the toner of the developer D on the transfer roller 36 is now less than or equal to 30%, an appropriate cleaning voltage may be used.

If the density of the toner is less than 35%, in operation S280, the controller 80 determines the appropriate cleaning voltage based on the measured transfer part resistance Rt and then applies the appropriate cleaning voltage via the voltage source Vi.

Due to the application of the cleaning voltage, the developer D on the transfer roller 36 is reverse transferred to the ITB 30 and then removed by the cleaning blade 40 as shown in FIG. 1.

According to an embodiment of the present embodiment, in a case where a reverse transfer due to a cleaning voltage is difficult because the density of the toner of the developer D on the transfer roller 36 is greater than or equal to the predetermined reference value, the carrier supplying unit 50 supplies the carrier. The density of the toner of the developer D on the transfer roller 36 is lowered due to the supply of the carrier, and thus the inverse transfer of the developer D to the ITB 30 becomes easy due to the cleaning voltage.

In the above described embodiment, the transfer part resistance Rt is measured to calculate the density of the toner of the developer D on the transfer roller 36. However, in still another embodiment of the present invention, a density of toner is measured using a density sensor 60, and if the density of the toner is greater than or equal to a predetermined reference value, a carrier is supplied.

Figure 10:
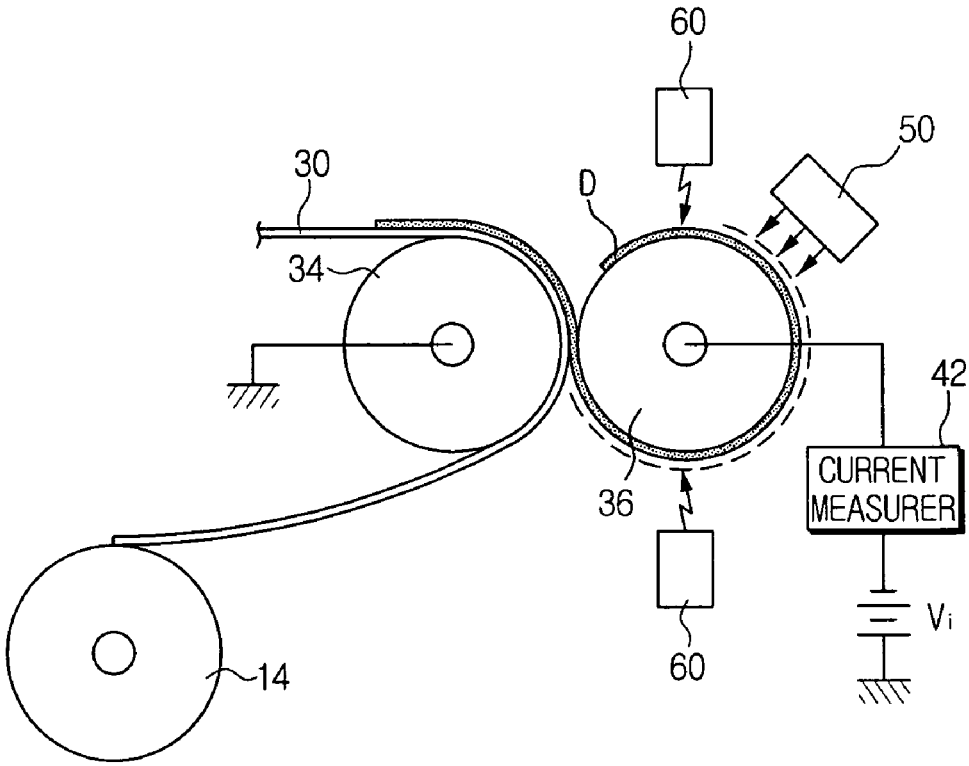
FIG. 10 is a view illustrating the configurations of parts of a wet-type image forming apparatus according to an embodiment of the present invention.
Figure 11:
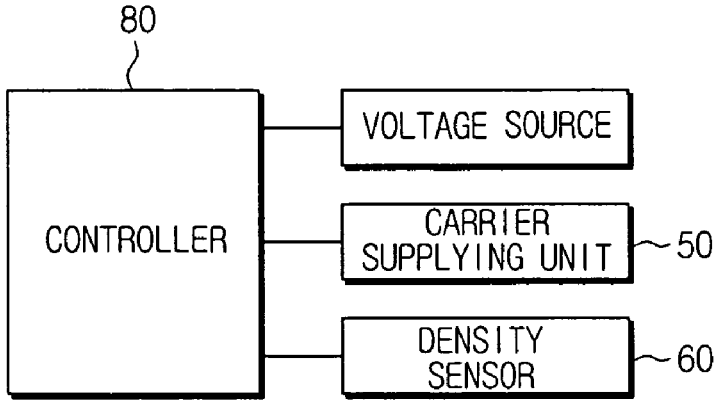
FIG. 11 is a block diagram of an apparatus for cleaning a transfer roller according to an embodiment of the present invention.

Referring to FIGS. 10 and 11, the density sensor 60 is a sensor for measuring a density of a general image. One or more density sensors are installed around the transfer roller 36. The density sensor 60 includes a light emitting device for irradiating light toward a developer D on the transfer roller 36 to be measured and a light receiving device for receiving reflected light to measure a density of an image. The light receiving device is a device, such as a photodiode or the like, for converting reflected light into an electric signal to measure the density of the image.

If the measured density of the toner is greater than or equal to the predetermined reference value, the controller 80 exchanges a signal with the density sensor 60 to control the carrier supplying unit 50 to supply carrier to the transfer roller 36 or the ITB 30. If the measured density of the toner is less than the predetermined reference value, the controller 80 preferably controls a voltage source to determine a cleaning voltage based on the measured density of the toner to apply the cleaning voltage. The carrier supplying unit 50 performs substantially the same function as that in the above described embodiment and thus a repeat description is omitted for clarity and conciseness.

Figure 12:
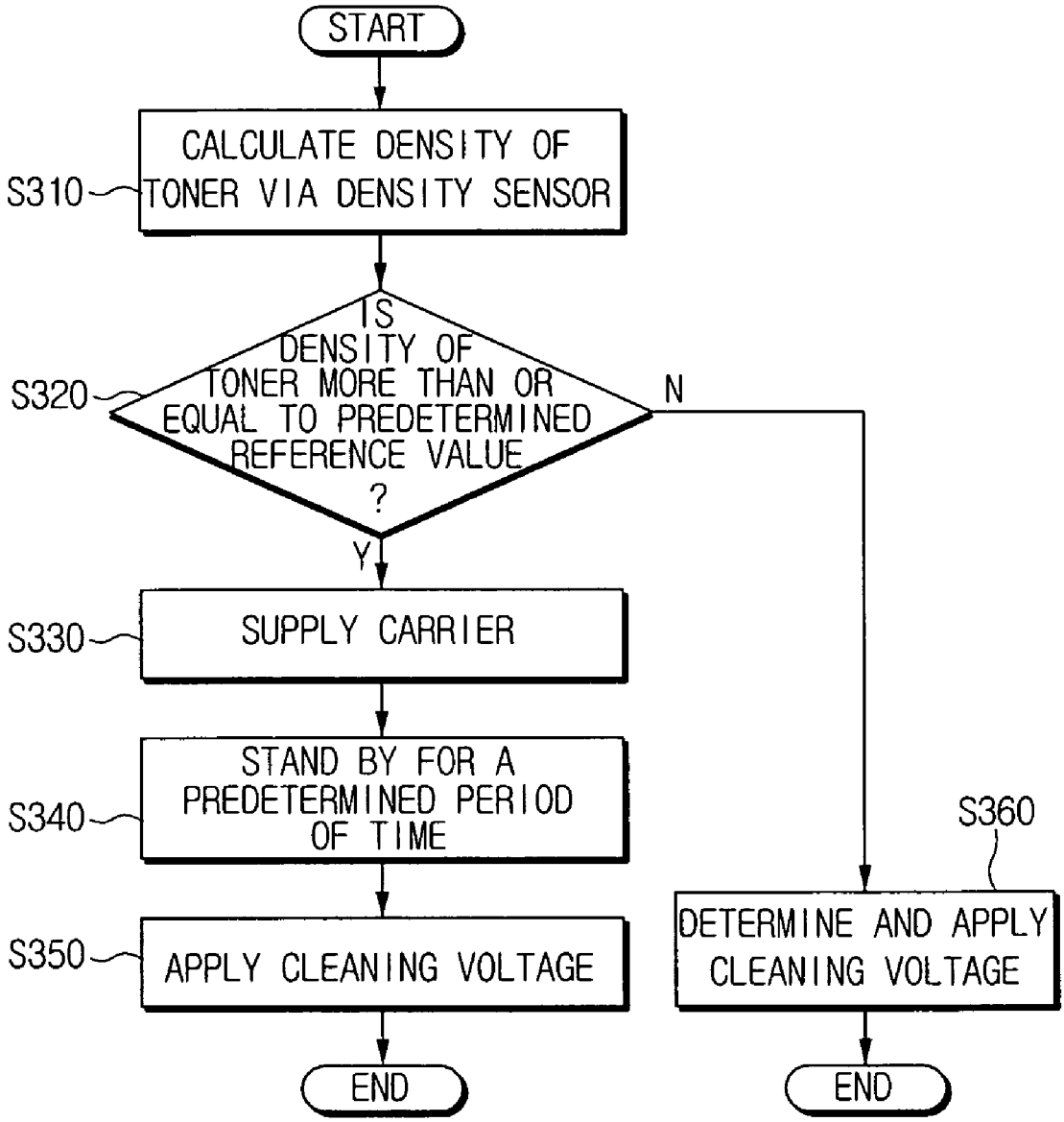
FIG. 12 is a flowchart of a method of cleaning a transfer roller according to an embodiment of the present invention.

FIG. 12 is a flowchart of a method of cleaning a transfer roller according to an embodiment of the present invention.

In operation S310, the density sensor 60 calculates the density of the toner of the developer D on the transfer roller 36.

Subsequent operations are substantially the same as those in the previous embodiment. In other words, in operation S320, the controller 80 determines whether the measured density of the toner is greater than or equal to the predetermined reference value. If the measured density of the toner is greater than or equal to the predetermined reference value, such as 35% for example, then in operation S330 the carrier supplying unit 50 supplies carrier to the transfer roller 36. In operation S340, the controller 80 stands by for a predetermined time. In operation S350, the controller 80 applies the cleaning voltage via the voltage source Vi to reverse transfer the developer D on the transfer roller 36 to the ITB 30. If the calculated density of the toner is less than 35%, then in operation S360 the controller 80 determines an appropriate cleaning voltage and applies the appropriate cleaning voltage via the voltage source Vi. Due to the application of the cleaning voltage, the developer D on the transfer roller 36 is reverse transferred to the ITB 30 and then removed by the cleaning blade 40 as shown in FIG. 1.

As described above, in an apparatus and a method for cleaning a transfer roller of a wet-type image forming apparatus according to an embodiment of the present invention, a cleaning voltage can be adjusted depending on a density of a toner of a developer sticking on the transfer roller. Thus, appropriate cleaning efficiency can be maintained.

Also, the density of the toner of the developer on the transfer roller can be measured. If the density of the toner is greater than or equal to a predetermined reference value, a carrier can be supplied so as to improve cleaning efficiency.

The foregoing embodiments and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art.

What is claimed is:

1. An apparatus for applying a cleaning electric power to a transfer roller of an image forming apparatus to clean the transfer roller, wherein the transfer roller faces a transfer backup roller to transfer an image formed on an intermediate transfer medium to a printing paper, and wherein the intermediate transfer medium is installed between the transfer roller and the transfer backup roller, the apparatus comprising:

an electric power source to apply a cleaning electric power among the transfer backup roller, the intermediate transfer medium, and the transfer roller;

a carrier supplying unit installed near one of the transfer roller and the intermediate transfer medium to supply carrier to a developer on the transfer roller; and a controller to measure a resistance among the transfer backup roller, the intermediate transfer medium, and the transfer roller, calculate a density of a toner of the developer on the transfer roller based on the resistance, and control the carrier supplying unit to supply carrier to at least one of the transfer roller and the intermediate transfer medium if the density of the toner is greater than or equal to a predetermined reference value.

2. The apparatus of claim 1, wherein the controller comprises:

a lookup table storage to store density values of the toner of the developer corresponding to values of the resistance.

3. The apparatus of claim 1, wherein if the density of the toner is less than the predetermined reference value, the controller controls the electric power source to determine the cleaning electric power based on the resistance and apply the cleaning electric power.

4. An apparatus for applying a cleaning electric power to a transfer roller of an image forming apparatus to clean the transfer roller, wherein the transfer roller faces a transfer backup roller to transfer an image formed on an intermediate transfer medium to a printing paper, and wherein the intermediate transfer medium is installed between the transfer roller and the transfer backup roller, the apparatus comprising:

an electric power source to apply a cleaning electric power among the transfer backup roller, the intermediate transfer medium, and the transfer roller;

a carrier supplying unit installed near one of the transfer roller and the intermediate transfer medium to supply carrier to a developer on the transfer roller;

a density sensor installed around the transfer roller to measure a density of a toner of the developer on the transfer roller; and a controller to exchange a signal with the density sensor and if the density of the toner is greater than or equal to a predetermined reference value, and control the carrier supplying unit to supply carrier to at least one of the transfer roller and the intermediate transfer medium.

5. The apparatus of claim 4, wherein if the density of the toner is less than the predetermined reference value, the controller controls the electric power source to determine the cleaning electric power based on the resistance and apply the cleaning electric power.

6. A method of applying a cleaning electric power to a transfer roller of an image forming apparatus to clean the transfer roller, the method comprising:

applying a measured electric power among a transfer backup roller, an intermediate transfer medium, and the transfer roller;

measuring a resistance among the transfer backup roller, the intermediate transfer medium, and the transfer roller based on the applied measured electric power;

calculating a density of a toner of a developer on the transfer roller based on the measured resistance;

supplying a carrier if the density of the toner is greater than or equal to a predetermined reference value; and applying a cleaning electric power.

7. The method of claim 6, further comprising:

storing density values of the toner of the developer on the transfer roller corresponding to resistance values among the transfer backup roller, the intermediate transfer medium, and the transfer roller.

8. The method of claim 7, wherein the density values of the toner of the developer on the transfer roller corresponding to the measured resistance is calculated with reference to a lookup table.

9. The method of claim 8 further comprising:

standing by for a predetermined time after supplying the carrier.

10. The method of claim 8, further comprising:

determining and applying the cleaning electric power based on the measured resistance if the density of the toner is less than the predetermined reference value.

11. A method of applying a cleaning electric power to a transfer roller of an image forming apparatus to clean the transfer roller, the method comprising:

calculating a density of a toner of a developer sticking on the transfer roller;

supplying a carrier if the density of the toner is greater than or equal to a predetermined reference value; and applying the cleaning electric power.

12. The method of claim 11 further comprising:

standing by for a predetermined time after supplying the carrier.

13. The method of claim 11, further comprising:

determining and applying the cleaning electric power depending on the density of the toner if the density of the toner is less than the predetermined reference value.

* * * * *